US005885065A

United States Patent [19]

Long

[11] Patent Number: 5,885,065

[45] Date of Patent: Mar. 23, 1999

[54] METHOD AND PUMP FOR PUMPING LIQUID CONTAINING SOLIDS

[76] Inventor: Marshall Long, 11147 Old Harbour Rd., North Palm Beach, Fla. 33408

[21] Appl. No.: 801,351

[22] Filed: Feb. 19, 1997

[51] Int. Cl.[6] ..... F04C 2/356; F04C 15/04

[52] U.S. Cl. ..... 418/1; 418/23; 418/187; 418/237; 418/247; 418/249

[58] Field of Search ..... 418/186, 187, 418/249, 1, 23, 237, 243, 244, 245, 247

[56] References Cited

U.S. PATENT DOCUMENTS

| | | | |
|---|---|---|---|
| 43,729 | 8/1864 | Weed | 418/187 |
| 500,361 | 6/1893 | Wankel | 418/186 |
| 550,919 | 12/1895 | Lesperance | 418/187 |
| 612,868 | 10/1898 | Price et al. | 418/249 |
| 795,142 | 7/1905 | Lewis | 418/247 |
| 1,047,436 | 12/1912 | O'Connor | 418/188 |
| 2,041,121 | 5/1936 | Fareso, Sr. | 418/245 |
| 2,232,951 | 2/1941 | Kosian | 418/187 |
| 3,314,368 | 4/1967 | Drutchas et al. | 418/188 |
| 3,649,141 | 3/1972 | Belcher | 418/186 |
| 5,015,161 | 5/1991 | Amin et al. | 418/6 |
| 5,277,558 | 1/1994 | Long | 417/481 |
| 5,613,846 | 3/1997 | Sommer | 418/186 |

FOREIGN PATENT DOCUMENTS

| | | | |
|---|---|---|---|
| 1304017 | 8/1962 | France | 418/186 |
| 1190795 | 4/1965 | Germany | 418/187 |
| 530888 | 7/1955 | Italy | 418/187 |
| 569795 | 6/1945 | United Kingdom | 418/187 |

*Primary Examiner*—John J. Vrablik
*Attorney, Agent, or Firm*—Shook, Hardy & Bacon

[57] ABSTRACT

A pump for pumping a liquid containing solids comprises a housing having a first end and second end and an interior pump chamber. An inlet pipe leads to the pump chamber through the first end, and an outlet pipe leads from the pump chamber at the second end. A core having a vane extending therefrom rotates within the chamber. The core has hollow portions permitting material to move from the inlet pipe to the pump chamber and from the pump chamber to the outlet pipe. The vane extends from the core outwardly, seals against the housing, and works in cooperation with a pair of moving blades to draw material from the inlet pipe and expel the material through the outlet pipe. The blades, which are arcuate in shape and have curved ends, are operated by pneumatic cylinders and move from a retracted position in which they are positioned out of the pump chamber to a deployed position in which the curved end sealably engages the core.

26 Claims, 6 Drawing Sheets

METHOD AND PUMP FOR PUMPING LIQUID CONTAINING SOLIDS

FIELD OF THE INVENTION

The present invention relates to a pump. More specifically, the invention is a positive displacement pump for pumping a liquid containing solid or semi-solid material.

BACKGROUND OF THE INVENTION

In food product manufacturing, liquids containing solids are frequently moved from one location or apparatus to another. When sufficiently viscous, these materials will move through pipes. A pumping apparatus is normally necessary, however, to effectuate movement of the material.

In many instances, the pump must not alter the character of the material. For example, it may be desirable to move a finished soup product from the processing area to the canning area. The soup may largely comprise liquid, but it may also contain solid or semi-solid matter, such as chunks or blocks of meat, vegetables, noodles, or the like. This product must move through the pump without being damaged in order for the product to retain its desired character.

A mechanism for pumping liquid containing solids which is efficient in pumping and which does not damage the product being pumped is needed.

SUMMARY OF THE INVENTION

The present invention is a positive displacement pump for pumping liquid containing solid or semi-solid material from an inlet to an outlet. In general, the pump comprises a housing having an interior chamber, a core with a vane extending therefrom which is mounted in the chamber, and a pair of movable blades for extension into and out of the chamber.

The housing has a first end and second end, each end having a throat for alignment with inlet and outlet pipes, respectively. The housing has a generally hollow interior and is cylindrical in shape.

The core is rotatably mounted in the housing, and has an outer diameter less than the inner diameter of the housing. The core has a first end and a second end corresponding to the first and second ends of the housing. An inlet throat is located in the first end of the core for alignment with the inlet pipe. The first throat leads to an inlet hollow interior portion of the core. A similar outlet throat is located in the second end of the core for alignment with the outlet pipe and leads to an outlet hollow interior portion of the core.

The first and second hollow interior portions of the core are separated by a vane which extends through the core and outwardly of the core, where the vane terminates against the interior of the housing.

The blades are curved members having a first end designed for engagement with the outside surface of the core, and a second end connected to an actuating device. The points of entry of the blades into the chamber are spaced approximately one-hundred and eighty degrees from one another. The actuating device for moving each blade into and out of the chamber preferably comprises a pneumatic cylinder.

Means are provided for rotating the core within the chamber. Preferably, a motor drives a belt, and the belt turns a cog-wheel mounted on a drive hub connected to the core.

Passages or throats at each end of the core extend between the hollow interior portions of the core and the inlet and outlet pipes. The throats are integrally formed with the core and therefore rotate with the core, and the throats are shaped to guide material from the inlet pipe into the inlet hollow interior chamber and from the outlet hollow interior chamber to the outlet pipe, respectively. The core is rotatably mounted with respect to the outlet pipe and the stationary inlet pipe.

Movement of the blades is preferably timed to rotation of the core. In particular, a timing system couples the drive hub to the pneumatic cylinders of the pump. In order to facilitate cleaning, the core and at least one end of the housing are removable.

In use, product enters the pump from the inlet pipe. The product is guided by the inlet throat into the inlet hollow interior chamber of the core. The material exits the core and enters the main pump chamber. There, with the core rotating, the vane moves the material around the chamber. Movement of the material is restricted by the blades, which are selectively extended into the chamber against the core after the vane passes, and retracted as the vane approaches. As the vane rotates, material builds up against one of the blades, forcing the material to re-enter the core and pass into the outlet hollow interior portion, wherefrom the material exits the pump through the outlet throat to the outlet pipe.

Advantageously, the curved nature of the blades reduces material destruction, and provides for enhanced sealing of the blades against the core. In addition, the vane is skewed, providing for smooth rotation of the vane about the chamber.

Further objects, features, and advantages of the present invention over the prior art will become apparent from the detailed description of the drawings which follows, when considered with the attached figures.

DETAILED DESCRIPTION

Figure 1:
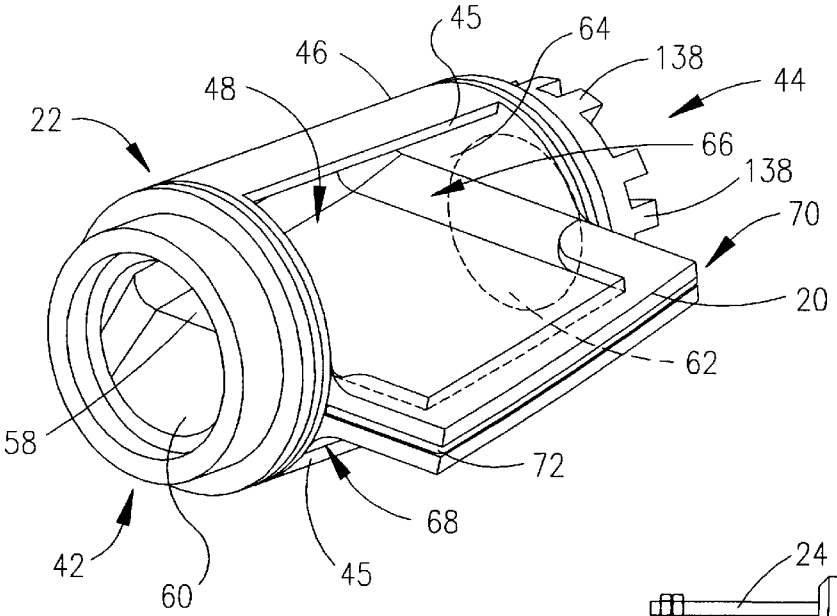
FIG. 1 is a perspective view of a core of the pump of the present invention.
Figure 2:
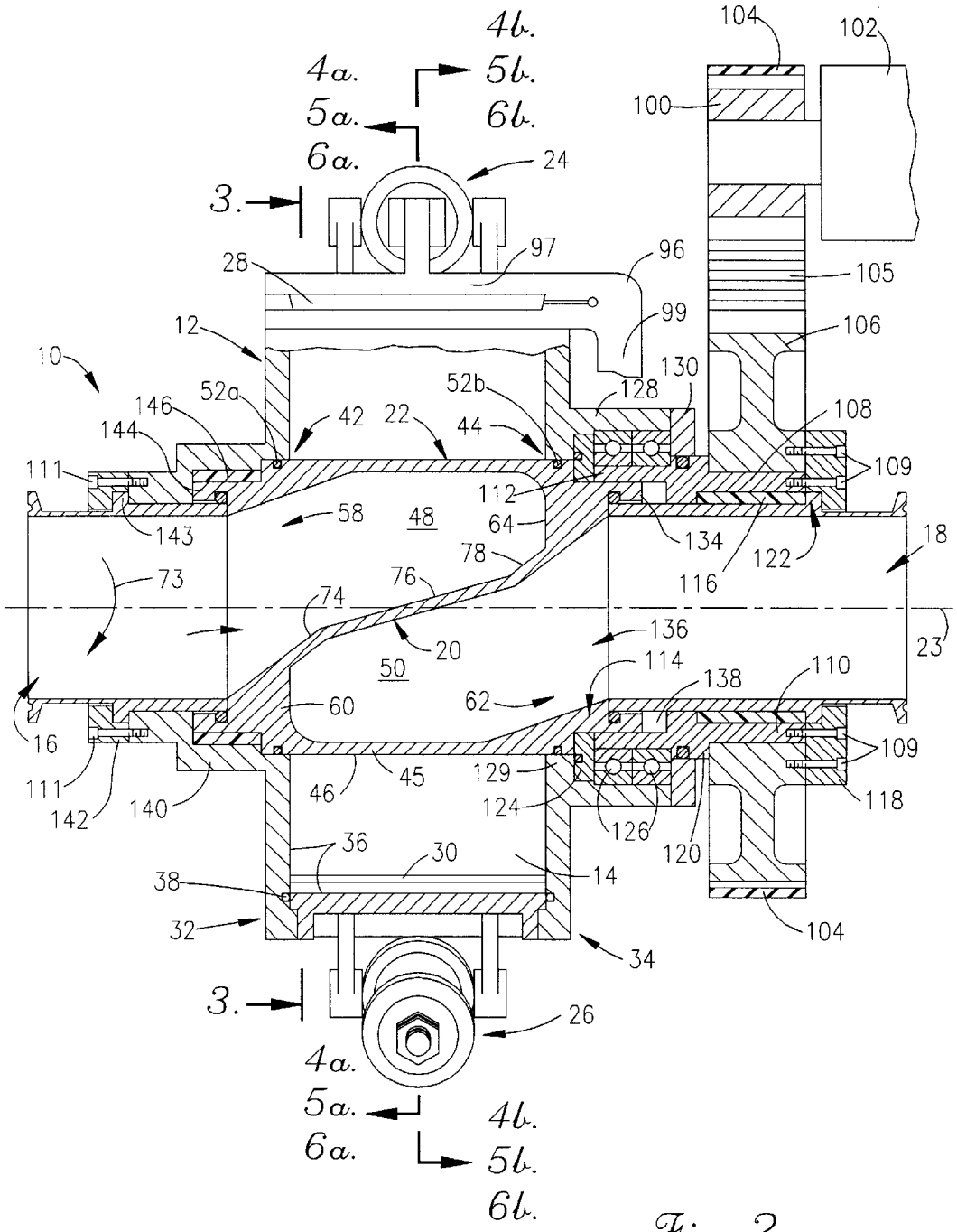
FIG. 2 is a cross-sectional side view of the pump of the present invention.
Figure 3:
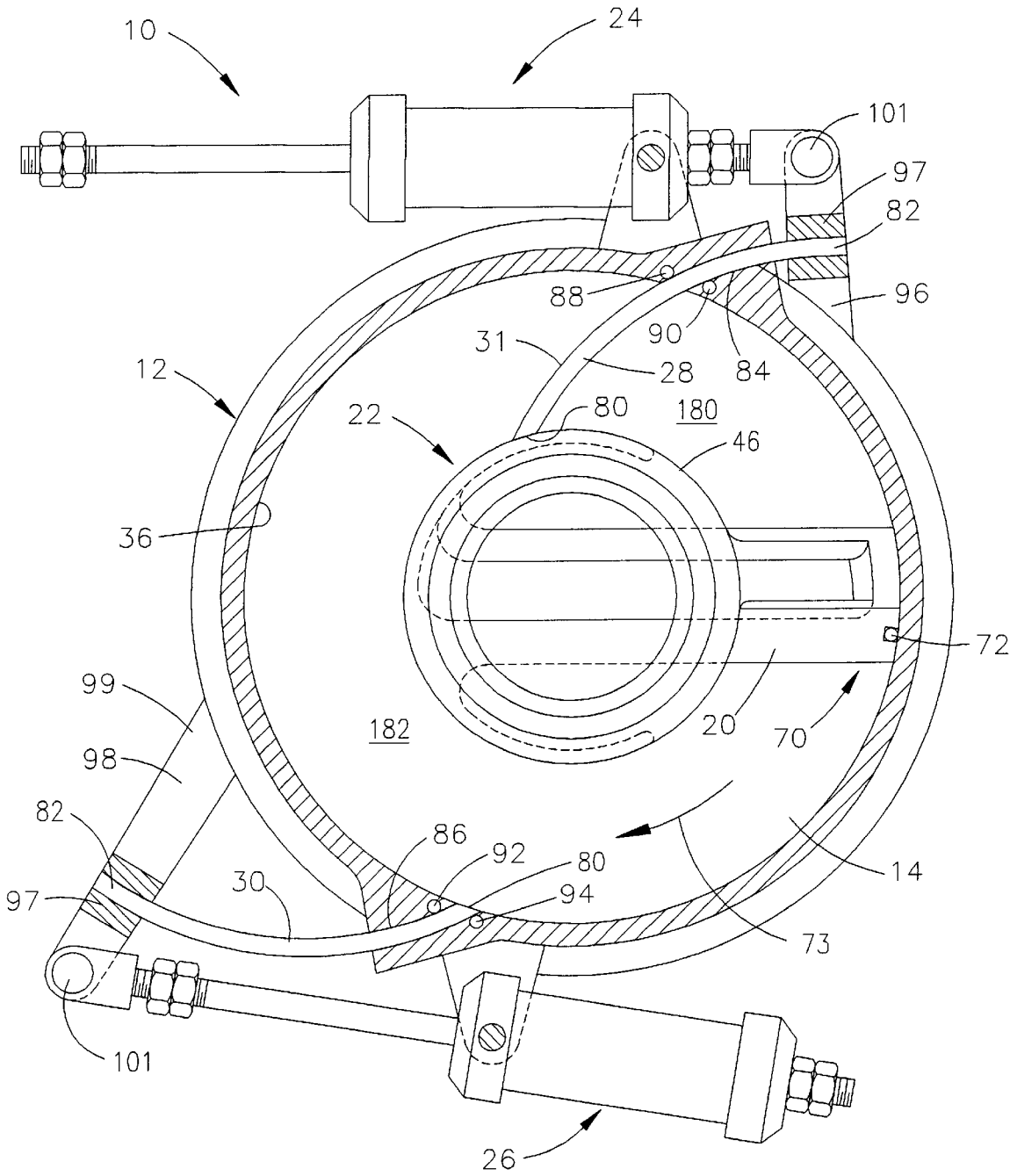
FIG. 3 is a cross-sectional view of the pump of FIG. 2 taken along line 3—3 illustrating an interior portion of the pump with an end of the core shown in elevation.

With reference initially to FIGS. 1–3, a pump 10 in accordance with the present invention is illustrated and described. In general, the pump 10 includes a housing 12 having a pump chamber 14. A product inlet pipe or passage 16 leads to the pump chamber 14 and a product outlet pipe or passage 18 leads from the pump chamber 14.

A core 22 having an integral vane 20 extending therefrom rotates within the pump chamber 14. Hence, the pump chamber forms an annular ring around the core. The vane 20 extends outwardly from the core 22, engaging an inner surface 36 of the housing 12 within the pump chamber 14, and the core is concentric and coaxial with the pump chamber and housing. Where the vane engages the inner surface of the housing it is angled to approximately 15° with a central axis 23 of the core and housing.

First and second pneumatic cylinders 24,26 selectively move corresponding first and second blades 28,30 into and out of sealing contact with the core 22 in the chamber 14. The rotating vane 20 and blades 28,30 cooperate to move material from the inlet pipe 16 through the pump chamber 14 to the outlet pipe 18.

The housing 12 comprises a substantially cylindrical member having a first closed end 32 and a second closed end 34. The housing 12 has an inner surface 36 defining the pump chamber 14. For a 3" pump, the chamber 14 is preferably about 9 inches in diameter and about 4 inches long. The exact dimensions may vary dependent on the material being pumped and the desired flow rate.

The housing 12 may be constructed of any of a number of food acceptable materials, including cast metal or the like. Preferably, at least the inner surface 36 of the housing 12 is of a durable and wear resistant material, such as stainless steel. This may be accomplished by installing a liner in the housing, or by forming the entire housing of that material.

To enable the user to clean the internal portion of the pump 10, the first end 32 and core are removable from the remainder of the pump housing 12, so that the pump may be cleaned without disassembling the drive end of the pump. A seal 38 is positioned between the first end 32 and the remainder of the housing 12. The first end 32 is preferably attached to the rest of the housing 12 with bolts (not shown), although other attachment means may be employed.

The inlet pipe 16 is in fluid communication with the pump chamber 14 of the housing 12 through the inlet hollow portion of the core. The inlet pipe 16 engages and is rotationally fixed to the first end 32 of the housing 12. The outlet pipe 18 communicates with the second end 34 of the housing but is not rotationally fixed thereto. In the preferred embodiment, each pipe 16,18 has the same outer diameter, which is 3 inches in the present embodiment, and an increased wall thickness near the core. The increased wall thickness provides extra thickness to engage an O-ring 200 (see FIG. 7) and adds strength for an attachment flange 143 (to be discussed below).

The rotatable core/vane combination, illustrated above in FIG. 1, is positioned in the pump chamber 14. The core and vane rotate about the axial centerline 23 passing through the ends 32,34 of the chamber 14. The core 22 is drum-shaped, having a first end 42 and a second end 44 and a partial outer shell 45. The outer shell defines an outer surface 46 and first/inlet and second/outlet hollow interior portions 48,50 are separated by the vane 20.

The core 22 is preferably constructed of food acceptable metal. The outer diameter of the core 22 is smaller than the diameter of the pump chamber 14 as measured to the inner surface 36. In the present embodiment, where the inner diameter of the chamber 14 is about 9 inches, the outer diameter of the core 22 is preferably about 4⅝ inches.

The core 22 is rotatable with respect to the housing 12. In particular, the first end 42 of the core 22 is mounted within bearing 146 which encircles the core. The core 22 is positioned within a passage through the center of the housing, so that the first end 42 of the core is adjacent the first end 32 of the housing 12. Bearing 116 mounts outlet pipe 18 relative to a drive hub 108 and adjacent a second end 44 of core 22, as shown. The second end 44 of the core 22 is positioned within the drive hub 108 and adjacent the second end 34 of the housing.

A first portion 58 of the first end 42 of the core 22 is open to the first hollow portion 48, while a second portion 60 of the first end is closed. The closed second portion 60 of the first end 42 forms a blind end of the second hollow portion 50. Similarly, a first portion 62 of the second end 44 of the hub 22 is open to the second hollow portion 50, while a second portion 64 is not. The closed second portion 64 of the second end 44 forms a blind end of the first hollow portion 48.

A first slot or opening 66 made in the outer shell 45 of the core extends along the length of the core 22 from near the open first portion 58 of the first end 42 to near the closed second portion 64 of the second end 44. This slot 66 connects the space within the first hollow portion 48 of the core 22 with the pump chamber 14 in which the core rotates. Similarly, a second slot 68 extends along the length of the core 22 from near the closed second portion 60 of the first end 42 to near the open first portion 64 of the second end 44. This slot 68 connects the space within the second hollow portion 50 of the core 22 with the pump chamber 14.

The vane 20 separates the slots 66,68, and defines a wall to separate the first and second hollow portions 48,50. In particular, the vane 20 extends along the core 22 between the ends 42,44 of the core, dividing it into halves. The vane 22 extends outwardly from one side of the inside wall of the core 22 beyond the outer diameter of the core a distance equal to the distance between the outer surface of the core 22 and the inner surface 36 of the pump chamber 14. Thus, the vane 20 has a free end 70 which terminates against the inner surface 36 of the housing 12. The length of the vane is greater than the length of the pump chamber because the vane extends across the entire length of the pump chamber at a 15° angle.

In order to create a seal between the vane 20 and the inner surface 36 of the housing 12, and between the vane and the ends 32,34 of the housing, a seal 72 or gasket extends around the perimeter of the portion of the vane extending from the core.

As best illustrated in FIGS. 1 and 3, the vane 20 is skewed, such that when rotating, the free end 70 of the vane 20 corresponding to the first end 32 of the housing 12 passes a point along the inner surface 36 of the housing (when rotating clockwise as viewed from the first end 42 to the second end 44) before the free end of the vane corresponding to the second end 34 of the housing. In particular, the vane 20 slants upwardly as viewed from the first to second end 32,34 of the housing 12, the angle of tilt or slant being a constant 15° from the free end 70 of the vane 20 towards the core 22 to a point at which the vane contacts the inside wall of the core. The skewed vane also aids the flow of fluid through the pump because it acts as an impeller.

The vane 20 is preferably constructed of stainless steel or similarly durable and food acceptable material, and the vane is formed integrally with the core 22.

The first/inlet and second/outlet hollow portions 48,50 of the core 22 are configured to smoothly transition the material moving through the pump 10 from the inlet pipe 16 to the pump chamber 14 and from the pump chamber 14 to the outlet pipe 18, respectively. In particular, as best illustrated in FIG. 2, the portion of the vane 20 within the first hollow portion 48 has a first segment 74 which extends generally upwardly (towards the outer shell 45 of the hub 22 as viewed from the first end 42 of the hub 22). The first segment 74 transitions into a second segment 76 which forms the 15° angle with the central axis 73 (as viewed in the same direction). The second segment 76 reduces the volume of the hollow portion 48. Lastly, a third segment 78 near the second end 44 of the core 22 curves upwardly, meeting the second end before the inner surface of the core 22 curves back as the outer wall comprising the core 22. The vane 20 has the identical shape on its opposite side within the second hollow portion 50, except in reverse, as illustrated in FIG. 2.

As stated above, the core 22 and vane 20 are mounted for rotation with respect to the housing 12 and inlet and outlet pipes 16,18. Drive means are provided for rotating the combined vane 20 and core 22.

Referring to FIG. 2, the drive means preferably comprises a pressure sensitive hydraulic motor (not shown), well known in the art. A toothed drive pulley 100 is mounted on an output or drive shaft 102 of the motor. The pulley 100 drives a cog belt 104 which extends around a portion of the pulley and a cogwheel 106 which is fixed to the drive hub 108 and rotatably mounted indirectly to the second end 34 of the housing 12 via rotational mounting over the outside of the outlet pipe 18. The cog wheel 106 is held on the drive hub by a split ring thrust bearing 118.

The drive hub 108 is connected by a plurality of crenelations or lugs 138 to the second end 44 of the core 22, whereby the rotation of the cogwheel 106 effectuates rotation of the core. The crenelations are asymmetrically spaced to form a keyed drive connection. Thus, the core can only be engaged with the drive mechanism with one (1) orientation, and therefore, the timing between the insertion/retraction of the blades and the rotation of the vane is maintained. The cogwheel 106 is circular in shape, having a toothed outer periphery for mating with the cogs or teeth 105 of the belt 104. The drive hub 108 has a first end 110 terminating at an outwardly facing side of the cogwheel 106. The drive hub 108 has a second end 112 which driveably engages the second end 44 of the core 22 via the crenelations 138 of the core. The drive hub 108 is generally cylindrical in shape, having an inner diameter slightly larger than the outer diameter of the outlet pipe 18, whereby the drive hub 108 is mounted over the outlet pipe. A bearing 116 separates the drive hub 108 and outlet pipe 18, permitting the outlet pipe 18 to remain stationary while the drive hub 108 rotates. In particular, a glass filled Teflon® bearing 116 is preferably mounted between the drive hub 108 and outer surface of the outlet pipe 18.

The cogwheel 106 and outlet pipe 18 are kept in place on the drive hub 108 by the split ring thrust bearing 118. The thrust bearing 118 which presses the drive hub 108 inwardly, is held in place by fasteners 109. The thrust bearing does not rotationally fix the outlet pipe to the drive hub but allows it to slide rotationally relative thereto, so that when the outlet pipe is connected with its "S" flange to a downstream pipe or other fixed elements, the outlet pipe remains stationary while the drive hub and thrust bearing rotate around it. For proper operation of the pump, it is not necessary to fix the outlet pipe rotationally. Therefore, the outlet pipe is left rotationally independent of the housing and the drive mechanism. The thrust bearing engages a flange 122 on the pipe to prevent the product flowing through the outlet pipe from pushing the outlet pipe out of the pump.

The second end 112 of the drive hub 108 is rotatable with respect to the second end 34 of the housing 12. The second end 112 of the drive hub 108 is attached with a conventional fastener (not shown) to a bearing retainer ring 124. The bearing retainer ring 124 is adjacent an inward flange 129 of the second end 34 of the housing 12. The inward flange 129 helps hold the retainer ring 124 and hence the bearings 126 in place, and the inward flange 129 allows the retainer ring to rotate relative to it. Further, a double ring of sealed ball bearings 126 extends around the outer surface of drive hub 108, separating the drive hub 108 from an annular outwardly extending sleeve 128 of the second end 34 of the housing.

A bearing retainer ring 130 encircles the drive hub 108 adjacent the end of the sleeve 128 of the second end 34 of the housing and is fastened thereto with a conventional fastener (not shown). The bearing retainer 130 retains the bearings 126 within the sleeve 128.

The outlet 114 of the core has a circumferential flange 134 sized to extend over the end of the outlet pipe 18. The outlet of the core is generally ring-shaped, having an angled outlet throat 136 therethrough. As illustrated, the inside of the outlet 114 is shaped to form the outlet throat 136 which directs material flowing from the pump chamber 14 of the pump 10 into the outlet pipe 18. The outlet throat 136 is shaped to direct material from the second hollow portion 50 of the core 22 through the open second portion 62 at the second end 44 into the outlet pipe 18. The outlet throat forms a transitional region from the substantially half round outlet hollow portion to the round outlet. In particular, because the open portion 62 of the second end 44 of the core 22 extends into the hollow portion 50, which is located off center in a half of the core, the outlet throat 136 passes through the outlet 114 at an angle to the central axis 23 and the pipe 18.

An end of the inlet pipe 16 is securely mounted to, and extends within, an outwardly extending sleeve 140 of the first end 32 of the housing 12. A split clamping ring 142, similar to that described above (118), extends around the inlet pipe 16, engaging an attachment flange 143 on the outer surface of the inlet pipe and thereby presses the pipe inwardly towards the housing 12. Clamping ring 142 is fastened with fasteners 111 to the sleeve 140 of the housing.

The core 22 has a circumferential inlet flange 144 which rotates with respect to the inlet pipe 16 and housing on a bearing 146. The inlet flange 144 is similar to the outlet flange 114 located at the second end 34 of the housing. An angled interior inlet throat 147 places the inlet pipe 16 in fluid communication with the inlet hollow portion 48. The inlet throat 147, which is a transitional region like the outlet throat from round to half round, is shaped to direct incoming material from the inlet pipe 16 into the first hollow portion 48 of the core 22 through the open first portion 58 in the first end 42 of the core 22.

To permit the inlet flange 144 and hence the core to rotate with respect to the sleeve 140 of the housing 32, the bearing 146, preferably a glass-filled Teflon® bearing, extends around the outside of the inlet flange 144 and inside of the sleeve 140 of the first end 32 of the housing 12.

As stated above, a pair of blades 28, 30 are selectively extendable into the chamber 14 for sealed engagement with the outer surface 46 of the core 22. Each blade 28, 30 comprises an arc-shaped member having a full width equal than the distance between the first and second ends 32, 34 within the chamber 14 of the housing 12.

As illustrated in FIG. 3, each blade 28, 30 is oriented so that when it extends into the chamber 14 and engages the core 22, pressure generated in the pump 10 have the effect of pressing on a convex surface 31 of each blade 28, 30, forcing the blade against the core 22. Thus, pump pressure enhances the sealing of the blades 28, 30 against the core 22.

Each blade 28, 30 has a first end 80 and a second end 82. The first end 80 is adapted to engage the core 22, and to form a portion of the inner surface 36 of the housing 12 to provide an uninterrupted inner pump surface when the blade is retracted. Specifically, the first end 80 of each blade 28, 30 is curved, having an end face which matches the shape of the outer surface 46 of the core 22. Because there is only a difference of 4 or 5 thousandths of an inch between the curvature of the core outer surface and the pump chamber inner surface, the curved end 80 of the blade effectively seals against the core and smoothly completes the pump chamber inner surface. Preferably, the curved end perfectly matches the curve of the core outer surface. It is also possible to slightly retract the blades into their respective slots to present a smooth pump chamber inner surface for the vane to pass over. The second end 82 of each blade 28, 30 is connected to activating means, as detailed below.

Each blade 28, 30 extends through a respective slot 84, 86 passing through the housing 12. The slots 84, 86 are preferably positioned opposite one another by 180 degrees around the circumference of the housing. The slots 84, 86 have dimensions slightly larger than the blades 28, 30, with seals 88, 90, 92, 94 positioned within the slots 84, 86 on each side of each blade 28, 30 to effectively seal the pump chamber 14 in each of these areas.

Activation means for moving the blades 28, 30 in and out of the chamber 14 are provided. Preferably, the activation means comprise an adjustable stroke pneumatic cylinder 24, 26 connected to the second end 82 of each blade 28, 30. The cylinders are also pivotally connected to the housing. Each pneumatic cylinder 24, 26 is connected to an air pressure source (not shown) and a control unit (not shown), as are well known in the art.

The actuating rod of each pneumatic cylinder 24, 26, is connected to an arm 96, 98. Each arm 96, 98 is pivotally connected to both its respective cylinder rod and the housing 12. Each arm 96, 98 is generally "L"-shaped, having a first portion 97 (FIG. 2) extending generally along the length of the pump (i.e. generally from the first to the second end 32, 34) and a second portion 99 extending generally radially in or down towards the centerline of the pump 10. The second portion is pivotally attached to the housing, and the first portion is pivotally connected to the second portion and to the cylinder rod with pivot connections 101.

The second end 82 of each blade 28, 30 is securely mounted to the first portion of its respective arm 96, 98. Preferably, each blade 28, 30 is bolted into a slot in the arm 96, 98 and is easily removable for cleaning.

Operation of the pump 10 of the present invention will be explained beginning with reference to FIGS. 2 and 3. The material to be pumped, such as a soup comprising a liquid containing solid or semi-solid particulate, is routed into the inlet pipe 16. The motor is then activated to effectuate movement of the vane and core 22 in the clockwise direction looking from the inlet to the outlet as illustrated by arrow 73. In operation, the core rotates at approximately 10 revolutions per minute. At such a speed, it pumps approximately 4,000 to 5,000 pounds of material per hour.

When the motor runs, the output shaft 102 of the motor turns, causing the pulley 100 thereon to turn as well. The pulley 100 moves the belt 104, rotating the cogwheel 106. Rotation of the cogwheel 106 causes rotation of the drive hub 108 on which it is mounted, thus causing the core 22 and vane 20 to rotate.

The direction of rotation of the vane 20 and core 22 is clock-wise within the pump chamber 14 (as viewed from the first end 32 to the second end 34) when the elements of the pump 10 are oriented as detailed above. Notably, rotation of these elements occurs while the inlet pipe 16 remains stationary. The outlet pipe 18 may also be stationary if connected to a fixed apparatus.

Figure 4A:
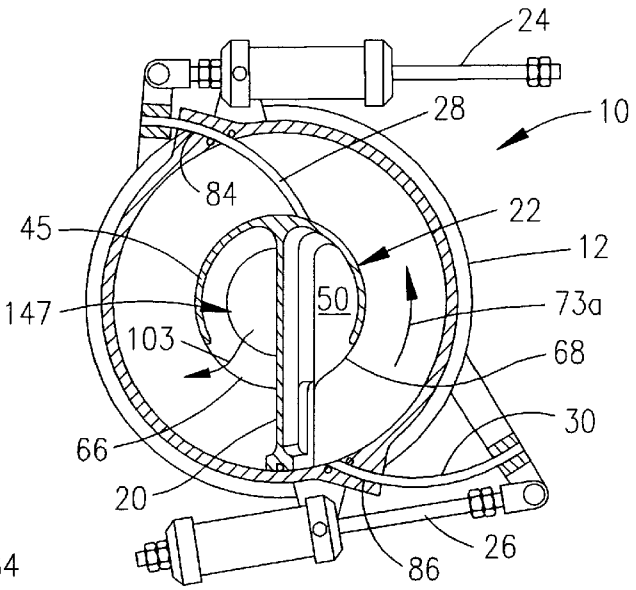
FIG. 4*a* is a schematic cross-sectional view illustrating said core in a first position taken along line 4*a*—4*a* of FIG. 2 as viewed towards an inlet of said pump.
Figure 4B:
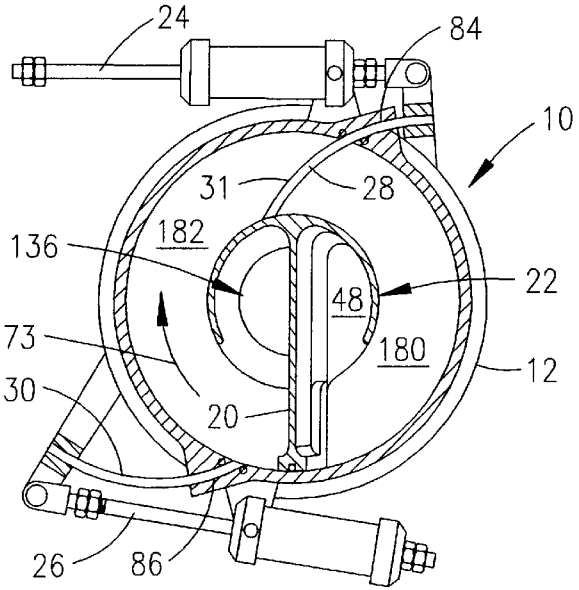
FIG. 4*b* is a schematic cross-sectional view illustrating said core in said first position taken along line 4*b*—4*b* of FIG. 2 as viewed towards an outlet of said pump.
Figure 5A:
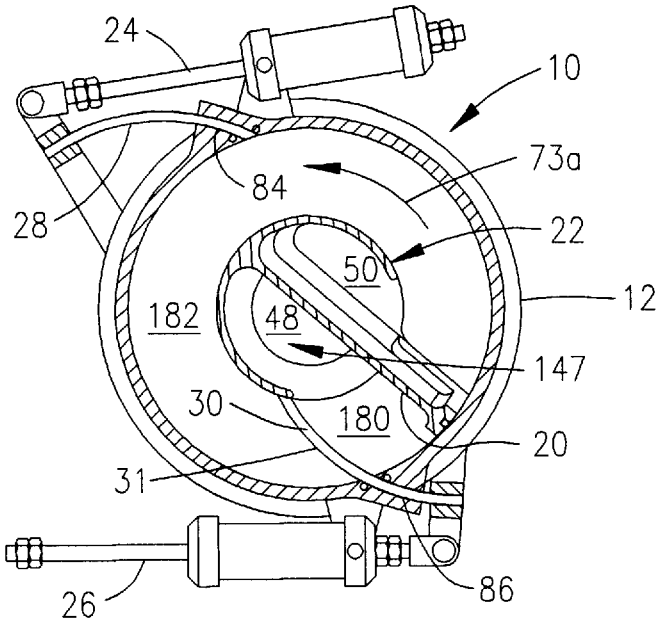
FIG. 5*a* is a schematic cross-sectional view illustrating said core in a second position taken along line 5*a*—5*a* of FIG. 2.
Figure 5B:
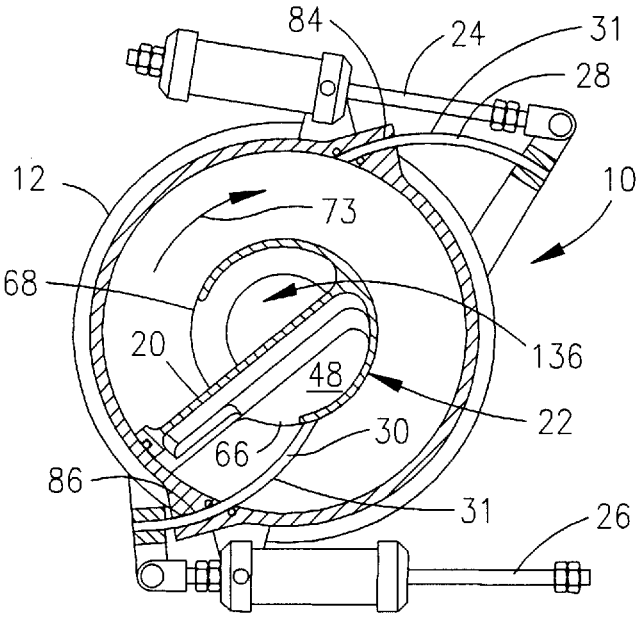
FIG. 5*b* is a schematic cross-sectional view illustrating said core in said second position taken along line 5*b*—5*b* of FIG. 2.
Figure 6A:
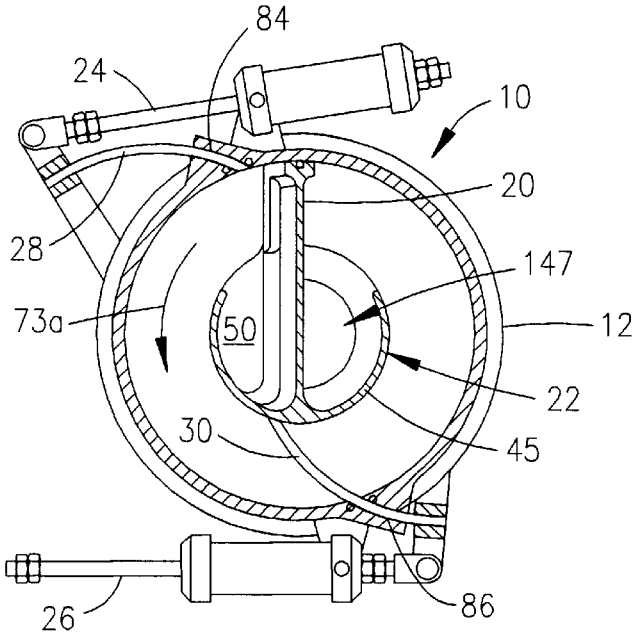
FIG. 6*a* is a schematic cross-sectional view illustrating said core in a third position taken along line 6*a*—6*a* of FIG. 2.
Figure 6B:
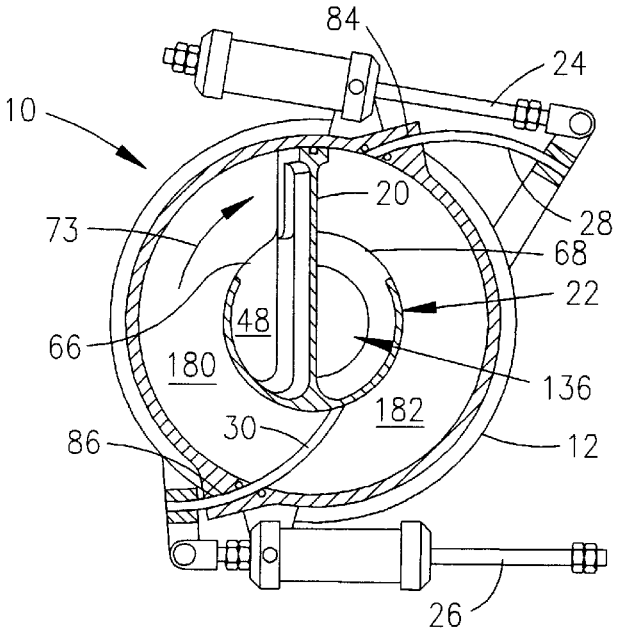
FIG. 6*b* is a schematic cross-sectional view illustrating said core in said third position taken along line 6*b*–6*b* of FIG. 2.

Movement of material through the pump 10 will now be described in conjunction with FIGS. 3–6. The description starts with the core 22 and vane 20 initially in the position illustrated in FIG. 3. In this position, the first blade 28 is extended and sealed against the core 22, and the second blade 30 is retracted out of the pump chamber 14. The inlet of the core always communicates with the inlet pipe 16, while the outlet of the core always communicate with the outlet pipe 18. The vane 20 and core 22 rotate in a clockwise direction, as illustrated by arrow 73 and the sequential change in position of the vane illustrated in FIGS. 3–6. Note that FIGS. 4*a*, 5*a*, and 6*a* are viewed in the opposite direction from FIGS. 3, 4*b*, 5*b*, and 6*b*. Thus, the direction of rotation is indicated by arrow 73*a* for FIGS. 4*a*, 5*a* and 6*a*.

Material is sucked in through the inlet pipe 16 and is directed through the throat 147 (FIG. 2) of the inlet into the inlet hollow portion 48 of the core 22. This material moves radially outward through the slot 66 into the pump chamber 14 as illustrated by arrow 103 (FIG. 4*a*), but it is constrained from moving in one direction by the vane 20 and from moving in the other direction by the blade 28. After the vane 20 moves past the slot 86, the second blade 30 extends through the housing 12 and seals against the core 22, as illustrated in FIGS. 5*a*–*b*. After the second blade sealably engages the hub, the first blade 28 retracts out of the chamber 14. Thus, there is always one blade separating the inlet hollow portion from the outlet hollow portion 50 and dividing the pump chamber 14 into an inlet part 180 behind the movement of the blade and an outlet part 182 in front of the movement of the blade. Thus, the inlet and outlet parts constantly rotate around the pump chamber, but the outlet part is always in communication with the outlet hollow portion; and the inlet part is always in communication with the inlet hollow portion, In an alternate embodiment, the blades are retracted and deployed at different times relative to each other. For example, the deployment of the blades may be switched simultaneously, or the retraction of one blade may be started just before the other blade seals against the core.

Material located in front of the vane 20 (as it turns clockwise) experiences increasing pressure, because the volume of the inlet part is increased by the moving vane. Because the material cannot move through the chamber in the clockwise direction as a result of the second blade 30 being closed, it is forced out of the pump chamber through the slot 68 into the hollow portion 50 and on through the outlet throat 136 into the outlet pipe 18. As the vane continues to turn, the volume of the inlet part of the pump chamber simultaneously increases in volume to draw or suck more material therein. The blades alternate to essentially switch material from the inlet part to the outlet part by instanteously increasing the volume of the inlet part and decreasing the volume of the outlet part. The blades are always deployed on the suction side behind the motion of the vane that is into the inlet part of the pump chamber. This causes the blade to be drawn into a sealed engagement with the core. This also prevents plastically deforming the blades which could prevent blade retraction. The curve of the blade also enables a thinner blade to be used. The convex shape of the blade simulates an arch structure supporting the pressure applied to the convex side, so that a thinner blade can be used. The thickness of the blade is approximately 5/16 inch, and because of the arch structure of the blade, it can be made from plastic. The thinner blade leads to less displacement of product as the blade is deployed and to smaller voids when the blade is retracted. Both of these factors reduce pulsation in the product flow.

This cycle repeats itself in succession, with the rotary pump 10 continuously pumping the material from the inlet pipe 16 out the outlet pipe 18. During each cycle (three-hundred sixty-degree revolution of the core 22), the vane 20 draws material into the pump chamber 14 behind the vane 20 while pushing material out of the pump chamber 14 on the front side of the vane 20 at the same time. Correspondingly, the vane 20 continuously pushes material out of the portion of the chamber 14 just filled and fills the portion of the chamber previously evacuated on the opposite side of the vane.

Movement of each blade 28, 30 is timed with respect to movement of the vane 20. As described above, the drive hub 108 which drives the vane 20 and core 22 mates in a particular position with drive lugs 138 located on the outlet sleeve portion 114 which is connected to the core 22.

Sensors or the like are mounted on the drive hub 108 which trigger the pneumatic cylinders 24, 26, causing them to move the blades 28, 30 in and out as appropriate.

As can now be understood, as the vane 20 moves, it generates pressure in front of it. This pressure is transmitted through the material being pumped and against whichever blade 28, 30 extends into the chamber 12. This pressure aids in pressing the blade 28, 30 against the core 22, enhancing the seal between the blade and core which exists because of the mating shape of the end of the blade with the outer surface shape of the core.

The angled or curved shape of the end 80 of the blade 28, 30 also aids in the passage of the vane 20 across the slot 84, 86 when the blade 28, 30 is retracted. The curved end 80 cooperates with the inner surface 36 of the chamber 14 to form a continuous smooth surface over which the end 70 of the vane 20 travels when the blade is retracted. The angled shape of the ends of the blades also allows the blades to cut through the material with less resistance.

The curved shape of the end of the blade 28, 30, the overall shape of the blade, and the direction of blade entry into the chamber 12 facilitates movement of the blade through the chamber 14. First, the shape of the blade and its angle of entry allow the blade to move through material in the chamber 12 without damaging it. Second, because the blade 28, 30 is curved and enters the chamber at an angle, its movement through the material in the chamber 12 has less effect on the material in the chamber 14 than would be the case if the blade were straight and entered the chamber in a radially linear fashion, i.e. straight toward the center of the core. This reduces potentially dangerous and product damaging pump pulsation which can occur as a result of the blades 28, 30 entering and retracting from the pump chamber 14.

The shape of the vane 20 is designed to permit it to move smoothly around the chamber 14. Because the vane 20 is skewed, less than the entire length of the free end 70 of the vane 20 crosses the blade slots 84, 86 at the same time. Thus, the vane passes the retracted blades progressively, not abruptly. To the extent there is a step or catch at the blade slots 84, 86 when the blades 28, 30 are retracted, the shape of the vane 20 prevents the vane 20 from catching in it, which might occur if the vane 20 were not skewed.

Significantly, the shapes and dimensions of the core 22, inlet and outlet hollow portions, inlet and outlet throats, and slots in the outer shell permit the pump to move the material without damaging it. As described above, it is critical that the material move through the pump 10 without the solid or semi-solid material therein being damaged. In the embodiment shown, the openings of the inlet and outlet pipe each have a cross-sectional area of approximately 6.5 $in^2$. The cross-sectional areas of the inlet and outlet throats 147, 136 are approximately 6.7 $in^2$. The cross-sectional area of the slots in the outer shell are approximately 7.0 $in^2$, and the pump chamber has a cross-sectional area of approximately 8.75 $in^2$. Thus, the material is never forced through a restrictive passage. The increase of the cross-sectional areas in the fluid path as the material moves toward the center of the pump allow the materials to pass, even under pressure, without destroying or adversely affecting the nature of the material being pumped. At a minimum, the cross-sectional areas of the fluid path are uniform from inlet pipe to outlet pipe. As a result, the material is not throttled through small passages or nozzles where rapid changes in pressure and/or contact with the pump surfaces could cause this material to be damaged.

The pump 10 of the present invention can be utilized as a "back-pressure" pump (i.e. where the inlet pressure is higher than the outlet pressure). In such a case, the direction of vane rotation would be reversed.

Figure 7:
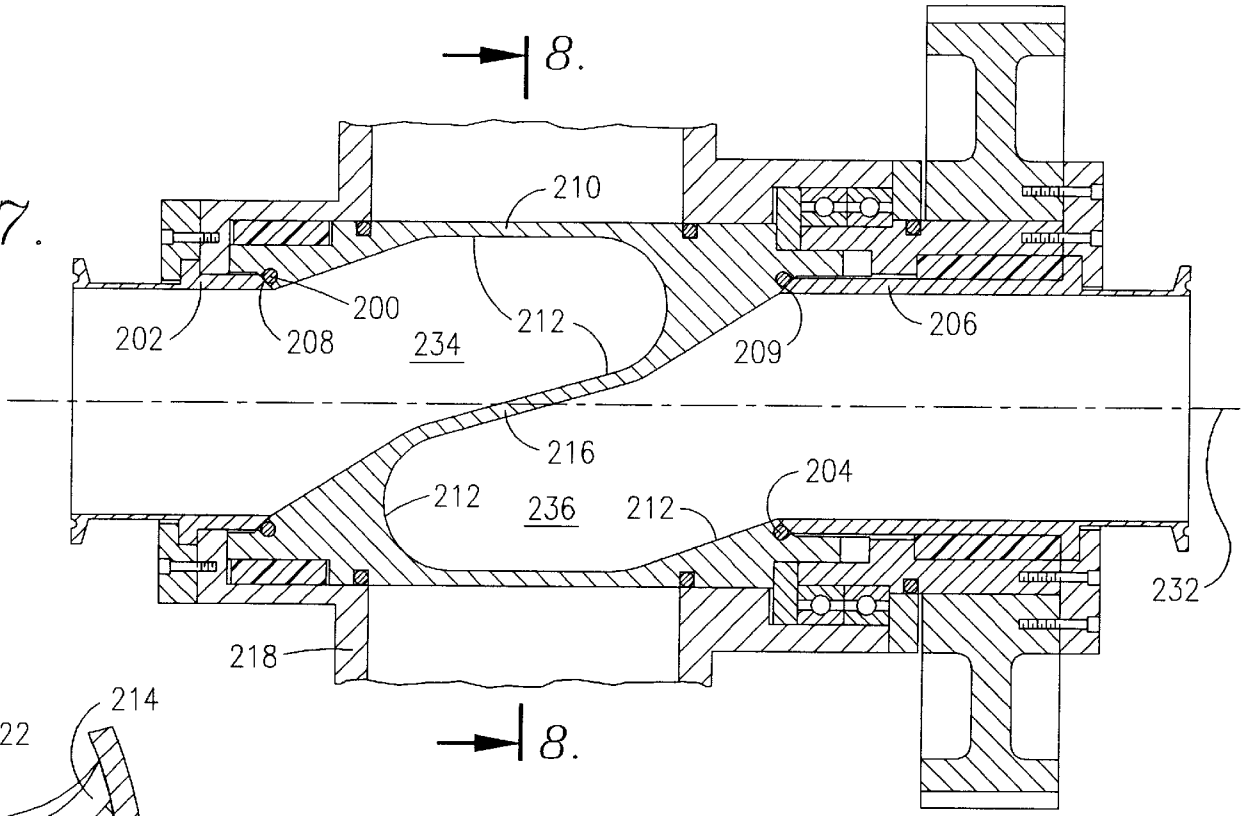
FIG. 7 is a fragmentary cross-sectional view of an alternate embodiment of the pump.
Figure 8:
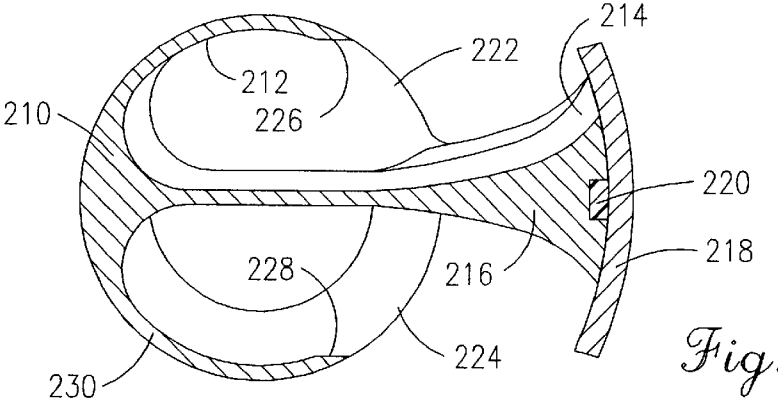
FIG. 8 is a cross-sectional view of the core of FIG. 7 taken along line 8—8.

FIGS. 7 and 8 illustrate an alternate embodiment of the core and other features, and thus, FIGS. 7 and 8 will be described only as they pertain to the alternate features. The core 210 has an inner surface 212 with a radius at every intersection between two surfaces to assure that there are no corners in which food material can stagnate and remain for extended periods of time. Thus, the inlet hollow portion 234 and the outlet hollow portion 236 are smooth in that there are no corners or edges. Further, the free end 214 of the vane 216 is flared. The flared end enhances the seal between the vane and the housing 218 because of the increased contact surface area and because the wider free end can receive a wider seal 220. The inlet slot 222 and the outlet slot 224 are increased in cross-sectional area by flattening the tips 226, 228 of the outer shell 230 of the core. The flattened tips increase the cross-sectional area but do not reduce the surface area available for the blades to engage.

An O-ring 200 seals the connection between the inlet pipe 202 and the core 210. Similarly, a second O-ring 204 seals the connection between the outlet pipe 206 and the core 210. The ends 208, 209 of the inlet and outlet pipes, respectively, are angled, preferably at approximately 45° with a central axis 232 of the pump. The angled ends engage the O-ring which are recessed into mating angled surfaces in the core, to seal the connections between the pipes and the core.

Variations of the pump 10 are contemplated from the preferred embodiment described above. For example, the sizes or dimensions of the pump elements may vary from those described. The drive means for the hub 22 may comprise an electric or gas motor or even a power-take off or the like. Further, the drive linkage between the drive means and hub 22 need not comprise a cog-toothed belt, but could comprise gears or the like. It is also possible to have a portion of the inlet and/or outlet pipes be rotatable with the hub 22. The activating means for the blades 28, 30 may be hydraulic or electric. If electric, it may be possible to utilize sensors on the starting hub or drive connected to circuiting for triggering activation of the blades 28, 30. The vane 20 may have any number of configurations from that described above. For example, the sides of the vane 20 need not include a recessed area to receive a seal.

It will be understood that the above described arrangements of apparatus and the method therefrom are merely illustrative of applications of the principles of this invention and many other embodiments and modifications may be made without departing from the spirit and scope of the invention as defined in the claims.

I claim:

1. A continuous rotary pump for moving material from an inlet source to an outlet source, the pump comprising:

a housing having an interior chamber with an inner surface;

a core rotatably mounted in said chamber;

a vane extending outwardly from said core and engaging said inner surface of said chamber wherein said vane is skewed relative to a central axis of the pump; and at least one blade for extension through said housing and into said chamber for selective engagement with said core, said blade being arcuate in shape.

2. The pump of claim 1, further comprising means for moving said blade.

3. The pump of claim 1, wherein said pump includes two blades.

4. The pump of claim 1, wherein said blade comprises a curved first end.

5. The pump of claim 2, wherein said means for moving comprises a pneumatic cylinder.

6. The pump of claim 1, further comprising: a hub wherein said hub includes an inlet hollow portion and an outlet hollow portion.

7. The pump of claim 6, wherein said vane divides a hollow interior section of said core into said hollow portions.

8. The pump of claim 1, wherein said core further includes a throat at a first end thereof, said throat extending to an inlet pipe.

9. The pump of claim 1, wherein said core further includes a throat at a second end thereof, said throat extending to an outlet pipe.

10. The pump of claim 1 further comprising a fluid path having a substantially constant cross-sectional area.

11. A continuous rotating pump for moving liquid containing solid or semi-solid material from an inlet source to an outlet source, comprising:

a housing having a first end, second end, and interior chamber;

a core having an outer surface and mounted within said chamber of said housing;

a vane extending from said core for engagement with said housing wherein said vane is skewed relative to a central axis of the pump;

a first blade and a second blade, each blade having a first end for engagement with said outer surface of said core;

means for moving said blades; and means for rotating said core within said chamber.

12. The pump of claim 11, wherein said core is cylindrical in shape and has a first end and a second end.

13. The pump of claim 12, wherein said first end of said core has a first opening in communication with a hollow inlet interior portion of said core and said second end of said core has a second opening in communication with a hollow outlet interior portion of said core.

14. The pump of claim 11, wherein said first end of said blades is curved for mating engagement with said outer surface of said core.

15. The pump of claim 11, wherein said means for moving said blades comprises at least one pneumatic cylinder pivotally mounted to said housing.

16. The pump of claim 11 further comprising a fluid path having a substantially constant cross-sectional area.

17. A rotary pump for pumping a fluid containing solids without altering the nature of the solids, the pump comprising:

a stationary housing having an inner surface and a central axis;

a substantially hollow rotary core rotatably mounted in the housing and having an outer shell;

an annular pump chamber defined between the housing and the core;

at least one blade extendable through the housing into the pump chamber dividing the pump chamber into an inlet part and an outlet part;

an inlet hollow portion in fluid communication with the inlet part and defined by the outer shell of the core;

an outlet hollow portion in fluid communication with the outlet part and defined by the outer shell of the core;

a vane separating the inlet hollow portion from the outlet hollow portion and extending from the core into the pump chamber and substantially sealing against the inner surface of the housing wherein said vane is skewed relative to a central axis of the pump; and a fluid flow path including the inlet hollow portion, inlet part, outlet hollow portion, and outlet part through which material is pumped.

18. The pump according to claim 17 wherein the vane comprises a flared free end.

19. The pump according to claim 17 wherein the hollow portions are smooth.

20. The pump according to claim 17 wherein the blade is convex toward the outlet part.

21. A method of pumping a material from an inlet source to an outlet source, said pump including a housing having an interior chamber, a core mounted in said chamber, said core having a vane extending therefrom wherein said vane is skewed relative to a central axis of the pump, and at least one blade for extension into said housing against said core, the method comprising:

rotating said core having said skewed vane within said housing;

aligning a hollow inlet interior portion of said core with said inlet source;

moving material from said inlet source into said hollow inlet interior portion of said core;

aligning a hollow outlet interior portion of said core with an outlet source;

selectively extending said blade into said chamber to block a section of said chamber;

selectively retracting said blade from said chamber; and pressing said material from said chamber through said hollow outlet portion of said core into said outlet source.

22. The method of claim 21, wherein said pump includes a second blade, and further including the step of selectively extending said second blade into said chamber.

23. The method of claim 21, wherein said blade is extended into said chamber after said vane rotates past a point at which said blade enters said chamber.

24. The method of claim 21, wherein said step of rotating said core further includes turning a drive hub connected to said core.

25. The method of claim 21, wherein said step of extending comprises actuating a pneumatic cylinder connected to said blade, and extending said blade into an inlet part of said housing.

26. A method of pumping a material from an inlet source to an outlet source, said pump including a housing having an interior chamber a core mounted in said chamber, said core having a vane extending therefrom, and at least one arcuate blade for extension into said housing against said core, the method comprising:

rotating said core within said housing;

aligning a hollow inlet interior portion of said core with said inlet source;

moving material from said inlet source into said hollow inlet interior portion of said core;

aligning a hollow outlet interior portion of said core with an outlet source;

selectively extending said arcuate blade into said chamber to block a section of said chamber wherein an end of said arcuate blade effectively seals against said core;

selectively retracting said arcuate blade from said chamber wherein said end of said blade forms a continuous surface with said interior chamber of said housing when in a retracted position; and pressing said material from said chamber through said hollow outlet portion of said core into said outlet source.

* * * * *